United States Patent [19]

Suzuki et al.

[11] 4,438,001

[45] Mar. 20, 1984

[54] OILING AGENT FOR TREATING SYNTHETIC FIBERS

[75] Inventors: Akira Suzuki; Fumitoshi Sugiura, both of Gamagorishi, Japan

[73] Assignee: Takemotoyushi Co. Ltd., Aichi, Japan

[21] Appl. No.: 448,911

[22] PCT Filed: Apr. 8, 1981

[86] PCT No.: PCT/JP81/00082

§ 371 Date: Dec. 3, 1982

§ 102(e) Date: Dec. 3, 1982

[51] Int. Cl.[3] ..... D06M 13/18; D06M 13/30; D06M 13/38; D06M 00/00

[52] U.S. Cl. ..... 252/8.7; 252/8.75; 252/8.8; 252/8.9

[58] Field of Search ..... 252/8.7, 8.75, 8.8, 252/8.9

[56] References Cited

U.S. PATENT DOCUMENTS 3,678,068 7/1972 Anello et al. ..... 252/8.9

3,963,628 6/1976 Park ..... 252/8.9

4,351,738 9/1982 Takahashi et al. ..... 252/8.75

FOREIGN PATENT DOCUMENTS 49-31996 3/1974 Japan ..... 252/8.9

56-53277 5/1981 Japan ..... 252/8.9

*Primary Examiner*—Maria Parrish Tungol

*Attorney, Agent, or Firm*—Fred Philpitt

[57] ABSTRACT

This invention is directed to an oiling agent for treating synthetic fibers which comprises a specified fluorine-containing ionic surfactant and a specified poly(oxyethylene-oxypropylene) ether derivative and further comprises or does not comprise a nonionic surfactant, a mineral oil and a fatty acid ester, and when the oiling agent is attached in the form of an aqueous solution or emulsion onto synthetic fibers in the production and processing steps thereof, lubricating property and anti-static property are imparted to the fibers to thereby improve the operability of the production, processing steps and the like of the fibers.

16 Claims, No Drawings

OILING AGENT FOR TREATING SYNTHETIC FIBERS

FIELD OF THE ART

This invention relates to a novel oiling agent for treating synthetic fibers which is suitable for effectively preventing generation and accumulation of static electricity in filaments, caused by contact of materials of guides, rolls, heaters, etc. with fiber filaments in the production step and the processing step of synthetic fibers, to thereby diminish various obstacles due to such generation and accumulation of static electricity.

ART OF THE BACKGROUND

Generally, in the case of thermoplastic synthetic fibers such as polyester, nylon, polypropylene, etc., an oiling agent for treating fibers is attached to unstretched filaments, followed by stretching to 4 to 5 times the original length and heat-set for fixing the properties. The resulting stretched filaments are further passed through advanced processing steps such as bulky processing, twisting, warping, knitting, weaving, etc. to give fiber products, and in such production step and processing step, filaments are industrially very often treated at considerably high speed and temperature; thus, various obstacles due to static electricity generated by such speed-up of production and processing, such as filament splitting, jumping-out from filament path, filament swing on heater, twining round roller, etc. have become a more and more serious problem. In order to diminish such obstacles and thereby carry out the production and processing with good efficiency, an oiling agent for treating fibers has been required which reduces static electricity generated on filaments due to friction as much as possible, further imparts a large extent of lubricating property onto filaments and does not contaminate heater so much.

As antistatic agents used for fiber-treating oiling agents, various kinds of ionic surfactants have so far been proposed, but it is pointed out that for the speed-up of the steps, and particularly under severe conditions of high temperature, high tension, high speed, etc., they have not been yet provided with fully satisfactory performances for various required characteristics as mentioned below.

Namely, under conditions of speed-up and higher temperature of the production and processing, such problems as (1) increase in frictional static build-up voltage, (2) deposition of tar onto heater and (3) increase in frictional coefficient are liable to be raised, and this results from inhibition of performances due to antistatic agent added to the fiber-treating oiling agent, inadequate choice of antistatic agent, its excess amount added, etc.

DISCLOSURE OF THE INVENTION

In view of the above-mentioned status, the present inventors have made studies on a fiber-treating oiling agent having a superior antistatic property, which is added in an amount in which the antistatic property is fully exhibited, and does not raise the above-mentioned various problems, and as a result, have confirmed that a fluoric ionic surfactant having a specific structure as described later exhibits a superior antistatic property, and when an oiling agent for treating synthetic fibers containing one kind or two kinds or more of the fluoric ionic surfactant and a lubricating agent such as a poly- (oxyethylene-oxypropylene) ether derivative is used, it is possible to diminish the above-mentioned problems; thus have attained the present invention.

An object of the present invention is to provide a fiber-treating oiling agent which effectively inhibits static electricity generated when filaments cause friction against guides, rollers, heaters, etc. in the production and processing of synthetic fibers, and yet does not cause various obstacles brought by antistatic agents contained in the treating oiling agent.

Another object of the present invention is to provide a fiber-treating oiling agent which effectively inhibits generation of antistatic electricity in an extremely small amount of antistatic agents added.

The present invention is directed to an oiling agent for treating synthetic fibers which comprises (I) 0.05 to 5% by weight of a fluorine-containing ionic surfactant or surfactants expressed by the following general formula:

General formula $$C_nF_{2n\pm1}-A-B$$

wherein

A: $-CF_2-$, $-O-(CH_2)_m-$ (m: integer of 1-3),

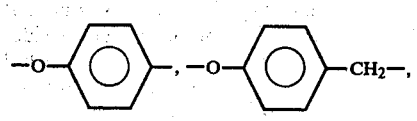

$$-O-CH_2-\underset{\underset{OH}{|}}{CH}-CH_2-,\ -SO_2.NH.C_3H_6-$$

B: $-SO_3M^1$ (1/k), $-COOM^2$, k: number of valency of metal $M^1$ $M^1$: Na, K, Ca, Mg, Ba $M^2$: Na, K $$-\overset{R_1}{\underset{R_2}{\overset{|}{\underset{|}{\oplus N}}}}-R_3.X^{\ominus},\ -\overset{R_1}{\underset{R_2}{\overset{|}{\underset{|}{N}}}}-CH_2COO^{\ominus}$$

$R_1$-$R_3$: alkyl of 1-20 carbon atoms

X: Cl, Br, I, $R_4SO_4$ $R_4$: $CH_3$ or $C_2H_5$ n: integer of 4-14;

(II) 30 to 99.95% by weight of a poly(oxyethylene-oxypropylene) ether derivative having a molecular weight of 1,000 to 10,000, obtained by adding ethylene oxide and propylene oxide to a monohydric or polyhydric alcohol of 1 to 20 carbon atoms, (III) 0 to 30% by weight of a nonionic surfactant; and (IV) 0 to 40% by weight of a mineral oil having a viscosity at 30° C. of 5 to 30 cst and/or a fatty acid ester having a molecular weight of 300 to 700.

A remarkable feature of the above fluoric ionic surfactant contained in the treating oiling agent of the present invention is that as apparent from the above formula of chemical structure, the surfactant has a structure wherein an ionic group is bonded to a carbon fluoride group, whereby the fluoric ionic surfactant is adsorbed in an orientation manner onto the surface of metals or fibers to thereby be able to notably reduce the surface energy; thus exhibits an extremely high degree of performance of preventing frictional static build-up voltage when the agent is added in a small amount.

As to the content of the fluoric ionic surfactant contained in the treating oiling agent of the present invention, a range of 0.05 to 5% by weight exhibits a good effectiveness, and a range of 0.1 to 3% by weight is more preferable.

If the content of the fluoric ionic surfactant is less than 0.05% by weight, it is impossible to fully satisfy the antistatic property required, while if its amount used exceeds 5% by weight, an amount of tar deposited onto heater increases; hence such excess amount is undesirable.

Representative examples of alcohols used as a raw material for the poly(oxyethylene-oxypropylene) ether derivative having a molecular weight of 1,000 to 10,000, obtained by adding ethylene oxide and propylene oxide to a monohydric or polyhydric alcohol of 1 to 20 carbon atoms, are monohydric alcohols such as methanol, butanol, 2-ethylhexanol, lauryl alcohol, stearyl alcohol, etc. and polyhydric alcohols such as ethylene glycol, glycerol, trimethylolpropane, pentaerythritol, sorbitol, etc. Among these alcohols used, mono- to tri- hydric alcohols are particularly preferable. The molecular weight of the poly(oxyethylene-oxypropylene) ether derivative is restricted by the theoretical molecular weight through the amounts of EO and PO raw materials fed, and ethylene oxide and propylene oxide are subjected to addition-polymerization to the alcohols in block or random manner, and the resulting derivative is used.

The ratio by weight of ethylene oxide (EO) and propylene oxide (PO) in the polyether derivative is preferably in the range of PO/EO=80/20 to 20/80.

As the purified mineral oil used together, those having a kinetic viscosity at 30° C. of 5 to 30 cst are used, and as the aliphatic esters, esters of a monobasic carboxylic acid of 8 carbon atoms or more and a monohydric alcohol or esters of a dibasic carboxylic acid and a monohydric alcohol, each having a molecular weight of 300 to 700, are used. Concrete examples of these aliphatic esters are butyl stearate (molecular weight: 340), n-octyl palmitate (molecular weight: 368), 2-ethylhexyl palmitate (molecular weight: 368), oleyl laurate (molecular weight: 450), isohexadecyl laurate (molecular weight: 424), isostearyl laurate (molecular weight: 452), dioctyl sebacate (molecular weight: 426), diisotridecyl adipate (molecular weight: 510), ethylene glycol dioleate (molecular weight: 590), trimethylolpropane trioctanoate (molecular weight: 512) pentaerythritol tetraoctanoate (molecular weight: 640), etc.

Next, examples of nonionic surfactants used together with, as lubricating agents, the poly(oxyethylene-oxypropylene) ether derivative, mineral oil, aliphatic ester, etc. and the fluoric ionic surfactant expressed by the above general formula in the treating agent of the present invention, are polyoxyethylene alkyl ethers, polyoxyethylene alkylphenyl ethers, polyoxyethylene alkyl esters, partial alkyl esters of polyhydric alcohols, etc. This nonionic surfactant functions as an emulsifier for emulsifying the lubricating agents into water; hence its proportion in the composition of the treating agent varies depending on the kind of the lubricating agents, and in case where the content of water-soluble poly(oxyethylene-oxypropylene) ether derivative in the lubricating agents is high, there is a case where it is zero.

Further, it is possible to add an emulsification-modifier, a wetting agent, a mildewproofing agent, a rust-proofing agent, etc. to the various blending materials, and the total amount of these additives is preferably 5% by weight or less based on the total amount of the blending materials.

The treating oiling agent of the present invention is attached to synthetic fiber filaments in the form of an aqueous solution or emulsion in an amount of 5 to 30% by weight.

The treating oiling agent of the present invention exhibits an effectiveness during the steps of production and processing of thermoplastic synthetic fibers such as those of polyester, polyamide, polyacryl, polypropylene, etc., and it is particularly effective as a spinning oiling agent for polyester filament for false twist processing.

Best embodiments for carrying out the invention

EXAMPLE 1

An oiling agent for spinning, of the present invention consisting of the following composition affords a superior aqueous emulsion:

5 parts by weight of a fluorine-containing anionic surfactant (I), 20 parts by weight of a mineral oil having a kinetic viscosity at 30° C. of 6.0 cst, 15 parts by weight of POE (8 mols) lauryl ether, 10 parts by weight of POE (12 mols) castor oil ether and 50 parts by weight of a poly(oxypropylene-oxyethylene) monostearyl ether which is a block addition type polyoxyalkylene ether compound (a) having a PO/PE ratio by weight of 50/50 and a molecular weight of about 3,000.

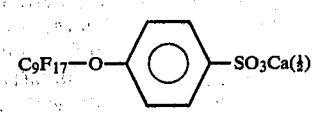

(I)

$$C_{18}H_{37}-O-(CH_2-\underset{\displaystyle CH_3}{\underset{|}{CH}}-O)_{23.53}-(CH_2-CH_2-O)_{31.02}-H \quad \text{(a)}$$

With this composition, the antistatic property and the frictional coefficient of fiber to metal were sought as follows:

Onto a multifilament of 36 stretched, semidull polyester filaments of 75 deniers was attached the present composition in the form of an aqueous emulsion in an amount of 0.4±0.1% based on the weight of the filaments, followed by subjecting the resulting material to moisture conditioning in an atmosphere of 65% RH, to obtain a sample filament. This sample filament was fed under an initial tension ($T_1$) of 20 g and at a rate of 700 m/min. and run in contact with a heater of 90 cm long maintained at 90° C., followed by subjecting it to frictional contact with a chrome-satinized pin at a contact angle of 90°, recording the exit side tension ($T_2$) and calculating the frictional coefficient ($\mu$) according to the following equation:

$$\mu = \frac{1}{\theta} \ln T_2/T_1$$

Further, a collector type, static charge gauge was placed at a location 5 cm behind the chrome-satinized pin, perpendicularly to the filament, to measure the static build-up voltage of the filament.

The results of the above measurements are shown below in comparison with the results of measurements with mineral oil-attached filament and non-oiled filament.

| Sample | Static build-up voltage | μ |
|---|---|---|
| Filament having present composition attached | +50 V | 0.28 |
| Filament having mineral oil of 6.0 cst attached | −300 V | 0.25 |
| Non-oiled filament | −800 V | 0.50 |

EXAMPLE 2

An oiling agent for spinning consisting of the following composition affords a superior aqueous emulsion:

A mixture (total amount: 50 parts by weight) of 5 parts by weight of a fluorine-containing anionic surfactant (II), 20 parts by weight of a mineral oil having a kinetic viscosity at 30° C. of 10.0 cst, 15 parts by weight of POE (8) lauryl ether, and 10 parts by weight of polyethylene glycol (M.W.: 400) dilaurate was dissolved in 900 parts by weight of ion-exchanged water, followed by adding and dissolving into the resulting emulsion, 50 parts by weight of a poly(oxypropylene-oxyethylene) monobutyl ether which was a random addition type polyoxyalkylene ether compound (b)/having a ratio by weight of PO/EO of 50/50 and a molecular weight of 1,700, to obtain a stable emulsion of 10% concentration. This composition of the oiling agent of the present invention was subjected to comparison measurement as in Example 1. The results are shown below. It has a superior antistatic property as in Example 1.

(I)

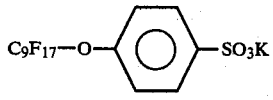

(b)

$$C_4H_9-O\left[(CH_2-\underset{\displaystyle CH_3}{\underset{|}{CH}}-O)_{14.02}-(CH_2CH_2-O)_{18.48}\right]-H$$

| | Static build-up voltage | μ |
|---|---|---|
| Filament having present composition attached | +100 V | 0.29 |
| Filament having mineral oil of 10.0 cst at 30° C. attached | −450 V | 0.26 |
| Non-oiled filament | −800 V | 0.50 |

EXAMPLE 3

An oiling agent for spinning consisting of the following composition affords a stable aqueous emulsion:

Two parts by weight of a fluorine-containing surfactant (III), 20 parts by weight of a mineral oil having a kinetic viscosity at 30° C. of 20 cst, 13 parts by weight of POE (8) oleyl ether, 10 parts by weight of POE (10) castor oil ether and 55 parts by weight of a poly(oxypropylene-oxyethylene) monoisooctyl ether (2-ethylhexyl) ether which was a block addition type polyoxyalkylene ether compound (c) having a PO/EO ratio by weight of 65/35 and a molecular weight of about 2,300:

(III)

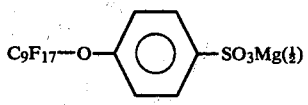

(c)

$$i\text{-}C_8H_{17}-O\left[CH_2-\underset{\displaystyle CH_3}{\underset{|}{CH}}-O\right]_{24.31}-(CH_2-CH_2-O)_{17.26}-H$$

The oiling agent for spinning of the present invention consisting of the above composition was subjected to comparison measurement as in Example 1. The results were as follows:

| | Static build-up voltage | μ |
|---|---|---|
| Filament having present composition attached | +80 V | 0.30 |
| Filament having mineral oil of 20 cst at 30° C. attached | −500 V | 0.27 |
| Non-oiled filament | −800 V | 0.50 |

EXAMPLE 4

An oiling agent for spinning, of the present invention consisting of the following composition affords a stable aqueous emulsion:

Two parts by weight of a fluorine-containing anionic surfactant (IV), 3 parts by weight of a fluorine-containing anionic surfactant (II), 20 parts by weight of a mineral oil having a kinetic viscosity at 30° C. of 30 cst, 15 parts by weight of POE (8 mols) oleyl ether, 10 parts by weight of POE (5 mols) nonylphenol ether and 50 parts by weight of a poly(oxypropylene-oxyethylene) monoalkyl (residual group of synthetic alcohol according to oxo process having 14 to 15 carbon atoms) ether which was a block addition type polyoxyalkylene ether compound (d) having a PO/EO ratio by weight of 60/40 and a molecular weight of 2,000:

(IV)

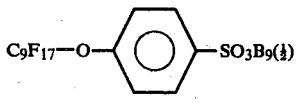

(d)

$$C_{14}H_{29}-O\left[CH_2-\underset{\displaystyle CH_3}{\underset{|}{CH}}-O\right]_{18.47}-(CH_2-CH_2-O)_{16.24}-H$$

The oiling agent for spinning of the present invention consisting of the above composition was subjected to comparison measurement as in Example 1. The results were as follows:

| | Static build-up voltage | μ |
|---|---|---|
| Filament having present composition attached | +40 V | 0.31 |
| Filament having mineral oil of 30 cst at 30° C. attached | −450 V | 0.29 |
| Non-oiled filament | −800 V | 0.50 |

EXAMPLE 5

An oiling agent for spinning of the present invention consisting of the following composition affords a superior aqueous emulsion:

Five parts by weight of a fluorine-containing anionic surfactant (V), 20 parts by weight of octyl palmitate, 15 parts by weight of POE (6 mols) oleyl ether, 10 parts by weight of POE (12 mols) castor oil ether, and 50 parts by weight of a poly(oxypropylene-oxyethylene) ether (e) (block addition type, PO/EO ratio by weight=80/20, M.W. about 3,000):

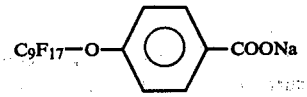

(V)

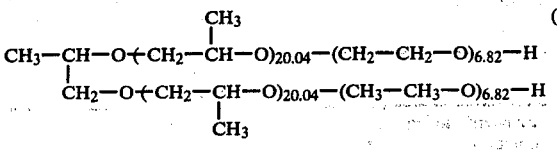

(e)

The present composition is an oiling agent for spinning having a superior lubricating property and antistatic property as in Example 1.

| | Static build-up voltage | μ |
|---|---|---|
| Filament having present composition attached | +80 V | 0.26 |
| Filament having isooctyl stearate attached | −380 V | 0.24 |
| Non-oiled filament | −800 V | 0.50 |

EXAMPLE 6

An oiling agent for spinning, consisting of the following composition affords a superior aqueous emulsion:

0.5 Part by weight of a fluorine-containing anionic surfactant (VI), 24.5 parts by weight of oleyl laurate, 15 parts by weight of POE (8) oleyl ether, 10 parts by weight of POE (12) castor oil, and 50 parts by weight of a poly(oxypropylene-oxyethylene) ether (f) (block addition, PO/EO ratio by weight=70/30, M.W. about 3,500):

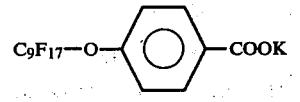

(VI)

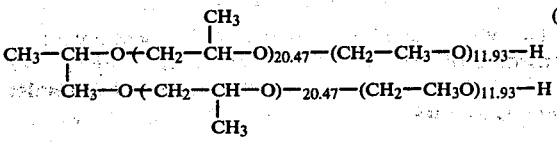

(f)

The fact that the present composition is an oiling agent for spinning having a superior lubricating property and antistatic property is apparent from the following results obtained by comparison measurement as in Example 1:

| | Static build-up voltage | μ |
|---|---|---|
| Filament having present composition attached | +60 V | 0.29 |
| Filament having oleyl laurate attached | −420 V | 0.27 |
| Non-oiled filament | −800 V | 0.50 |

EXAMPLE 7

An oiling agent for spinning, of the present invention consisting of the following composition affords a superior aqueous emulsion:

Three parts by weight of a fluorine-containing surfactant (VII), 22 parts by weight of dioctyl sebacate, 15 parts by weight of POE (6) nonylphenol, 10 parts by weight of POE (3) oleic acid ester, 30 parts by weight of a poly(oxypropylene-oxyethylene) ether (g) (block addition, PO/EO ratio by weight=80/20, M.W. 5,000) and 20 parts by weight of a poly(oxypropylene-oxyethylene) monostearyl ether (a):

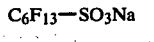

(VII)

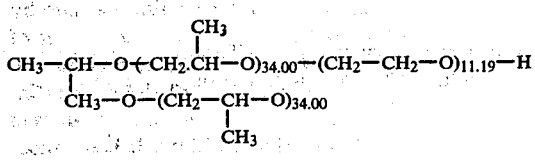

(g)

(a): polyoxyalkylene ether compound of Example 1

The fact that the oiling agent of the present invention consisting of the present composition has a superior lubricating property and antistatic property is apparent from the following results obtained by comparison measurement as in Example 1:

| | Static build-up voltage | μ |
|---|---|---|
| Filament having present composition attached | +80 V | 0.28 |
| Filament having dioctyl sebacate alone attached | −600 V | 0.26 |
| Non-oiled filament | −800 V | 0.50 |

EXAMPLES 8–11

Oiling agents for spinning, of the present invention containing fluorine-containing ionic surfactants having the compositions in Examples 8–11 shown in the following Table were compared with those containing conventional hydrocarbon antistatic surfactants, with regard to antistatic property of a polyester filament. The results are shown in the following Table:

| | Example | | | | Comparative example | | | | |
|---|---|---|---|---|---|---|---|---|---|
| | (8) | (9) | (10) | (11) | (1) | (2) | (3) | (4) | (5) |
| Poly (PO/EO) ether pentaerythritol (d) | 50 | 50 | 50 | 50 | 50 | 50 | 50 | | Non-oiled |
| Tetraoctanoate | 20 | 20 | 20 | 20 | 20 | 20 | 20 | 100 | |
| POE (12) castor oil | 15 | 15 | 15 | 15 | 15 | 15 | 15 | | |
| POE (6) oleyl alcohol | 10 | 10 | 10 | 10 | 10 | 10 | 10 | | |
| F-containing anionic surfactant (VIII) | 5 | | | | | | | | |

-continued

| | Example | | | | Comparative example | | | | |
|---|---|---|---|---|---|---|---|---|---|
| | (8) | (9) | (10) | (11) | (1) | (2) | (3) | (4) | (5) |
| surfactant (IX) | | 5 | | | | | | | |
| surfactant (X) | | | 5 | | | | | | |
| F-containing cationic surfactant (XI) | | | | 5 | | | | | |
| Lauryl sulfonate-Na | | | | | 5 | | | | |
| Dodecylbenzene-sulfonate Na | | | | | | 5 | | | |
| Oleic acid-Na | | | | | | | 5 | | |
| Static build-up voltage | +80 | +55 | +60 | +70 | −200 | −500 | −180 | −600 | −800 |

Note 1:
The measurement method of static build-up voltage is the same as in Example 1.
Note 2:
The contents of F-containing surfactants are as follows:

(VII) $C_8F_{17}—SO_3Na$ (IX) $C_6F_{13}—O—CH_2—COONa$ (X) $C_8F_{17}—O—CH_2—\underset{\underset{OH}{|}}{CH}—CH_2SO_3Na$ (XI) $C_8F_{17}—SO_2NH—C_3H_5—\overset{\overset{CH_3}{|}}{\underset{\underset{CH_3}{|}}{\oplus N}}—CH_3\ Br^{\ominus}$ As apparent from the above Table, the oiling agents for spinning, of the present invention are superior in the antistatic property.

EXAMPLE 12

An oiling agent for spinning, of the present invention consisting of the following composition affords a stable aqueous emulsion:

Five parts by weight of a fluorine-containing surfactant (XII), 10 parts by weight of a mineral oil having a kinetic viscosity at 30° C. of 7.5 cst, 10 parts by weight of isostearyl laurate, 15 parts by weight of POE (10) lauric acid ester, 10 parts by weight of a polyethylene glycol (400) dilaurate and 50 parts by weight of a poly(oxypropylene-oxyethylene) monostearyl ether compound (a) (used in Example 1):

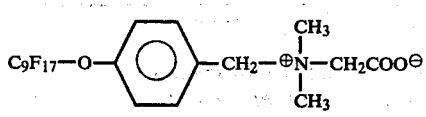

(XII)

A 15% aqueous emulsion of this composition was attached onto an unstretched polyester filament extruded-spun at a take-up speed of 1,500 m/min., in advance of take-up, in kiss roll manner, in an amount of oil attached, of 0.6% by weight. Taken-up, unstretched polyester filaments (490 deniers, 48 filaments) were subjected to heat stretching by means of a stretching machine and the resulting stretched polyester filaments (150 deniers, 48 filaments) were taken up into a pirn. Static electricity on the pirn just after take-up was measured by means of a collector type charge gauge. Further, the stretched filaments (150 deniers, 48 filaments) thus obtained were subjected to false twist processing under the following conditions, and static build-up voltage of the filaments just after passage through a first heater was measured by a collector type charge gauge: The results were as follows:

| | Static build-up voltage on pirn after stretching | Static build-up voltage of filaments just behind false twist heater |
|---|---|---|
| Filament having present composition attached | +10-+20 V | +5-10V |

The false twist conditions are as follows:

| | |
|---|---|
| Filament speed | 160 m/min. |
| Number of revolutions of spindle (pin) | 400,000 rpm |
| Heater temperature | 210° C. |
| Heater length | 150 cm |
| Percentage overfeed | 2% |

As seen from the above, static build-up of filaments was scarcely observed at both the steps and the operability of the steps was very smooth.

EXAMPLE 13

An oiling agent for spinning, of the present invention consisting of the following composition affords a stable aqueous solution:

0.5 Part by weight of a fluorine-containing anionic surfactant (XIII), 14.5 parts by weight of POE (12) lauric acid ester, 65 parts by weight of a poly(oxypropylene-oxyethylene) monobutyl ether (random addition, PO/EO ratio by weight=50/50, M.W. 1,200) (h) and 20 parts by weight of a poly(oxypropylene-oxyethylene) ether (random addition, PO/PE ratio by weight=25/75, M.W. 8,000) (i)

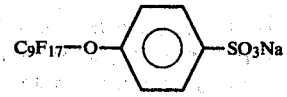

(XIII)

$$C_4H_9—O\left(CH_2—\overset{\overset{CH_3}{|}}{CH}—O\right)_{9.71}\left(CH_2—CH_2—O\right)_{10.13}H \quad \text{(h)}$$

-continued

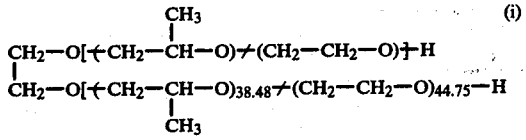

(i)

A 10% aqueous solution of this composition was attached onto a polyester POY (Partially Oriented Yarn) extruded-spun at a take-up speed of 3,500 m/min., in advance of take-up, in kiss roll manner, in an amount of oil attached, of 0.4% by weight.

Taken-up polyester POY (230 deniers, 30 filaments) was subjected to simultaneous stretching and false twist processings by means of a stretching-false twisting machine under the following conditions, to obtain the following operational effectiveness:

False twist conditions

| | | |
|---|---|---|
| Filament speed | 240 m/min. | |
| Number of revolutions of spindle (pin) | 600,000 rpm | |
| Stretch ratio | 1.530 | |
| Heater temperature | 210° C. | |
| Heater length | 150 cm | |
| | Static build-up of filaments just behind first heater | Number of days till heater tar occurs |
| Filament having present composition attached (230 d/30 filaments) | +10–20 V | 2 months |

No filament swing phenomenon due to static electricity in the heater was observed; a very stabilized operability was exhibited; and the quality of the DTY filament thus obtained was superior.

With an oiling agent of the present composition and other oils for comparison, a laboratorial anti-tar-formation test was carried out according to the following method:

A sample (5 g) was precisely weighed and taken in a stainless steel dish of 7.4 cm in diameter and heated in a heating oven adjusted to 220° C.±2° C. for 20 hours, followed by cooling, weighing and measuring the amount of tarry residue. The results are shown in the following Table in terms of % by weight based on the amount of the sample taken (excluding moisture):

| Results | Heating residue % |
|---|---|
| Oiling agent for spinning, of present composition | 1.56 |
| Poly(oxypropylene-oxyethylene) monobutyl ether (h) | 0.12 |
| POE (12) lauric acid ester | 13.4 |
| Mineral oil of 18 cst (30° C.) | 5.6 |
| Mineral oil of 30 cst (30° C.) | 20.6 |
| Isooctyl stearate | 10.1 |
| Isotridecyl stearate | 43.6 |
| Coconut oil | 81.2 |

It is understood from the above results that the oiling agent for spinning, of the present composition is very small in the amount of residue by long term heating and hence small in the heater-contaminating property. It is also understood that an oiling agent having a large amount of residue according to this testing method, ultimately has a large amount of tar or oil drop; hence it is undesirable as an oiling agent for false twist processing.

EXAMPLE 14

An oiling agent for spinning, of the present invention consisting of the following composition affords a stable aqueous solution:

0.05 Part by weight of a fluorine-containing anionic surfactant (XIII), 99.95 parts by weight of a poly(oxypropylene-oxyethylene)trimethylolethane ether (random addition type, PO/EO ratio by weight=40/60, M.W. 3,500) (j)

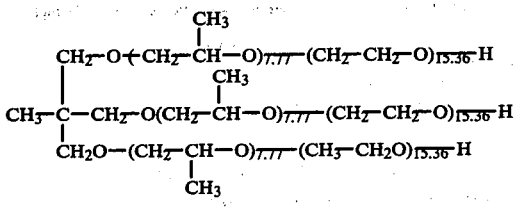

(j)

Using a 10% aqueous solution of this composition, POY was prepared as in Example 13, and the POY was subjected to stretching and false twist under the following conditions to exhibit a superior operability as follows:

False twist conditions

| | | |
|---|---|---|
| Filament speed | 550 m/min. | |
| Material of friction type spindle | Ni/diamond coating (three shafts) | |
| Peripheral speed of the above spindle | 1045 m/min. | |
| D/Y ratio* | 1.9 | |
| Heater temperature | 220° C. | |
| Heater length | 150 cm | |
| Stretching ratio | 1.530 | |
| | Static build-up voltage of filaments just behind first heater | Durtion till heater is cleaned |
| Filament having oiling agent for spinning, of present composition attached | −20–−30 V | 2 months |

*Ratio of peripheral speed of disc/filament speed

No filament swing phenomenon due to static electricity in the heater was observed, and a superior operaility was exhibited.

Further, the amount of residue by heating was measured as in Example 13. The results are shown below. The advantage of the oiling agent of the present invention is understood as in the case of the previous Example.

| | Heating residue % |
|---|---|
| Oiling agent for spinning, of present composition | 0.59 |
| Poly(oxypropylene-oxyethylene)-trimethylolethane ether (j) | 0.25 |

Several preparation examples of main substances used in the above various Examples will be mentioned below as experimental examples, to more clarify practical embodiments.

EXPERIMENTAL EXAMPLE 1

Preparation of potassium p-perfluorononeyloxybenzoate (1) Preparation of p-perfluorononenyloxybenzyl benzoate Into a 1 l four-neck flask equipped with a stirring means, a reflux condenser, a dropping funnel and a thermometer were introduced perfluoro-3-isopropyl-4-methyl-2-pentene (obtained according to the method of the invention of Japanese patent application laid-open No. Sho No. 50-117705) (99 g, 0.22 mol) and p-hydroxybenzyl benzoate (228 g, 0.20 mol), and N,N-dimethylformamide (400 ml) as a reaction solvent was added, followed by dropwise adding trimethylamine (22.2 g, 0.22 mol) through a dropping funnel with stirring at 25° C. over 15 minutes and then reacting them at 25°–30° C. for 60 minutes.

After the reaction, the contents were poured in 2 l of water for reprecipitation, followed by filtering off and drying the precipitate to obtain white crystalline p-perfluorononenyloxybenzyl benzoate ($C_9F_{17}OC_6H_4COOCH_2C_6H_5$) (125 g) (yield: 95%).

(2) Preparation of potassium p-perfluorononenyloxybenzoate

Next, into a 500 ml three-neck flask equipped with a stirring means, a reflux condenser and a thermometer were introduced p-perfluorononenyloxybenzyl benzoate (125 g, 0.19 mol) obtained above in (1) and a 5% aqueous solution (247 g) of KOH (KOH, 0.22 mol), and the benzoate was subjected to saponification decomposition with stirring at 80°–90° C. for 2 hours. After the reaction, the resulting material was cooled down to room temperature and then excess alkali was neutralized with dilute hydrochloric acid.

Next, the resulting material was twice extracted with n-hexane (100 ml) and benzyl alcohol formed by the saponification decomposition was removed, followed by concentrating the aqueous layer so as to give 200 g, cooling down to room temperature, filtering off the resulting precipitate, again recrystallizing from water (100 g) and drying, to obtain white powdery potassium p-perfluorononenyloxybenzoate (83.5 g, yield 73%).

EXPERIMENTAL EXAMPLE 2

Preparation of sodium p-perfluorononenyloxybenzenesulfonate (1) Preparation of perfluorononenylphenyl ether Perfluoro-3-isopropyl-4-methyl-2-pentene (180 g, 0.40 mol) obtained as in Experimental example 1, phenol (41.4 g, 0.44 mol) and benzene (300 ml) were taken, and trimethylamine (44.6 g, 0.44 mol) was dropwise added through a dropping funnel with stirring at 40°–50° C. over one hour, followed by reacting them at the same temperature for 2 hours. After the reaction, the reaction mixture was washed with dilute hydrochloric acid and water and then distilled under reduced pressure to obtain perfluorononenylphenyl ether of b.p. 52°–54° C./

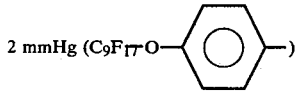

(206 g, yield 98%).

(2) Preparation of sodium p-perfluorononenyloxybenzenesulfonate

Into a 500 ml four-neck flask equipped with a stirring means, a reflux condenser and a thermometer were added perfluorononenylphenyl ether (157.2 g, 0.30 mol) obtained above in (1) and fuming sulfuric acid (30% anhydrous sulfuric acid) (88.2 g), and the mixture was reacted at room temperature for 6 hours, followed by pouring the contents in water (1 l), gradually adding an aqueous solution of NaOH to neutralize them till they became neutral, further adding a saturated aqueous solution of NaCl (300 g) for deposition, extracting the resulting deposit with ethyl alcohol (300 ml), twice recrystallizing it from ethyl alcohol (300 ml) and drying to obtain white crystalline sodium p-perfluorononenyloxybenzenesulfonate

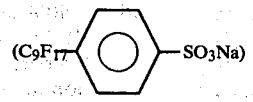

(152 g, yield 81%).

EXPERIMENTAL EXAMPLE 3

Preparation of N,N-dimethyl-N-p-perfluorononenyloxybenzylaminobetaine (1) Preparation of p-perfluorononenyloxybenzyl chloride Into a 500 ml three-neck flask equipped with a stirring means, a relfux condenser and a thermometer were introduced perfluorononenylphenyl ether (157.2 g, 0.3 mol) obtained in Experimental example 2(1), acetic acid (135 g, 2.25 mols), ferric chloride (72.9 g, 0.45 mol) and monochlorodimethyl ether (58.4 g, 0.66 mol), and the mixture were reacted at 70° C. for 80 hours, followed by pouring the contents in water (2 l), separating a water-insoluble layer, and distilling this layer under reduced pressure, to obtain p-perfluorononenyloxybenzyl chloride of b.p. 86.5°–87.0° C./1.5 mmHg (161 g, yield 94%).

(2) Preparation of N,N-dimethyl-N-p-perfluorononenyloxybenzylamine

Into the same flask as in the above (1) were introduced p-perfluorononenyloxybenzyl chloride (154.5 g, 0.27 mol) obtained above in (1) and a 40% aqueous solution of diethylamine (130.5 g) (diethylamine 1.16 mol), and the mixture was reacted with stirring at room temperature for 3 hours, followed by pouring the reaction material in water (2 l), separating a water-insoluble layer and distilling this layer under reduced pressure to obtain N,N-dimethyl-N-p-perfluorononenyloxybenzylamine of b.p. 90°–90.5° C./1.5 mmHg (153 g, yield: 98%).

(3) Preparation of N,N-dimethyl-N-p-perfluorononenyloxybenzylaminobetaine

Into a 1 l three-neck flask similar to that in the above (1) were introduced N,N-dimethyl-N-p-perfluorononenyloxybenzylamine (58 g, 0.10 mol), Na monochloacetate (17.4 g, 0.15 mol) and water (500 mols), and the mixture was reacted at 90° C. for 12 hours, followed by distilling off water under reduced pressure, extracting the residue with methanol (500 ml), filtering off an insoluble matter and distilling off methanol to obtain N,N-dimethyl-N-p-perfluorononenyloxybenzylaminobetaine (61 g, yield 95%) expressed by the formula

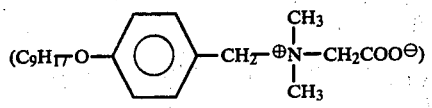

EXPERIMENTAL EXAMPLE 4

Preparation of N,N,N-trimethyl-N-{3-(perfluorooctylsulfonamide)-propyl}ammonium bromide In a 2 l four-neck flask similar to that in Experimental example 1(1), perfluorooctanesulfonyl fluoride (100.4 g, 0.20 mol) and N,N-dimethyl-N-aminopropylamine (22 g, 0.22 mol) were dissolved in diethyl ether (1 l), and to the resulting solution was dropwise added a 40% aqueous solution of NaOH (20 g, NaOH 0.20 mol) through a dropping funnel with stirring at room temperature, followed by reaction for 3 hours. The reaction material was then 3 times washed with water (500 ml), followed by separating the aqueous layer, dropwise adding to the resulting organic layer, methyl bromide (28.5 g 0.30 mol) while keeping the liquid temperature at 5° C. or lower, stirring for one hour, filtering off the resulting deposit, recrystallizing it from methanol (800 ml) and drying, to obtain light-yellow, powdery N,N,N-trimethyl-N-{3-(perfluorooctylsulfonamide)propyl}-ammonium bromide (130 g, yield 96%) expressed by the formula

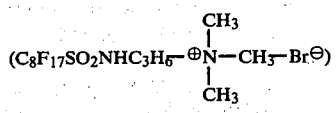

EXPERIMENTAL EXAMPLE 5

Preparation of sodium perfluorohexyloxyacetate

Into a 500 ml three-neck flask equipped with a stirring means, a reflux condenser and a thermometer were added perfluorohexanol (33.6 g, 0.10 mol), Na monochloroacetate (12.8 g, 0.11 mol), NaOH (4.4 g, 0.11 mol) and N,N-dimethylformamide (200 ml) as a reaction solvent, and the mixture was reacted at 110°-120° C. for 10 hours, followed by filtering off the resulting NaCl deposit. Crystals deposited after cooling were filtered off, recrystallized from ethanol (150 ml) and dried to obtain Na perfluorohexylacetate ($C_6F_{13}OCH_3COONa$) (32.4 g, yield 78%).

EXPERIMENTAL EXAMPLE 6

Preparation of sodium 3-perfluorooctyloxy-2-hydroxypropanesulfonate

In a 500 ml three-neck flask equipped with a stirring means, a reflux condenser and a thermometer were taken perfluorooctanol (43.6 g, 0.10 mol), Na 3-chloro-2-hydroxypropanesulfonate (21.6 g, 0.11 mol) and NaOH (4.4 g, 0.11 mol), and there was added N,N-dimethylformamide (200 ml), followed by reaction at 110°-120° C. for 10 hours and then the same treatment as in Experimental example 5, to obtain sodium 3-perfluorooctyloxy-2-hydroxypropanesulfonate (42.9 g, yield 72%).

As to preparation of sodium p-perfluorononenyloxybenzoate, p-fluorononenyloxybenzylbenzoate (125 g, 0.19 mol) obtained in Experimental 1(1) was reacted with an aqueous solution of NaOH as in Experimental example 1(2) to obtain a white powdery sodium p-perfluorononenyloxybenzoate (75.7 g, yield 68%).

Further, p-fluorononenyloxyphenyl ether (157.2 g, 0.3 mol) obtained in Experimental 2(1) was reacted with an aqueous solution of KOH as in Experimental example 2(2) to obtain a white crystalline potassium p-fluorononenyloxybenzenesulfonate (144.5 g, yield 75%).

In addition, this potassium p-perfluorononenyloxybenzenesulfonate, (64.2 g, 0.10 mol) was subjected to metathetical treatment with an aqueous solution of CaCl to obtain a white crystalline calcium p-perfluorononenyloxybenzenesulfonate (42.4 g, yield 68%).

Further, potassium p-perfluorononenyloxybenzenesulfonate (64.2 g, 0.10 mol) was subjected to metathetical treatment with an aqueous solution of $MgCl_2$ to obtain a white crystalline magnesium p-perfluorononenyloxybenzenesulfonate (43.7 g, yield 71%).

As to barium p-fluorononenyloxybenzenesulfonate, too, potassium p-perfluorononenyloxybenzenesulfonate (64.2 g, 0.10 mol) was subjected to metathetical treatment with an aqueous solution of $BaCl_2$ to obtain a white crystalline product (53.1 g, yield 79%).

As to sodium p-fluorohexenyloxybenzenesulfonate, perfluoro-2-methyl-2-pentene (120 g, 0.40 mol), phenol (41.4 g, 0.44 mol) and trimethylamine (44.6 g, 0.44 mol) gave perfluorohexenyloxyphenyl ether of b.p. 74°-76° C./19 mmHg (142 g, yield 9.5%) according to the same method as in Experimental 2(1), and this product (112.2 g, 0.30 mol) gave a white crystalline product (108.5 g, yield 76%) according to the same method as in Experimental example 2(2).

Poly(oxyethylene-oxypropylene) ether derivatives are produced according to methods as shown summarily below:

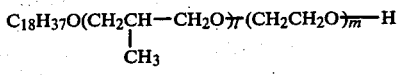

KOH (15 g, 0.27 mol) as catalyst was added to stearyl alcohol (270 g, 1.0 mol), and propylene oxide (PO) (1,365 g, 23.53 mols) and ethylene oxide (EO) (31.2 mols) were subjected to addition reaction thereto, followed by neutralizing the reaction material with an aqueous solution of phosphoric acid, dehydrating and filtering to obtain a colorless, transparent poly(oxyethylene-oxypropylene) monostearate (PO/EO ratio by weight=50/50, M.W. 3,000, block polymer) (2,940 g, yield 98%).

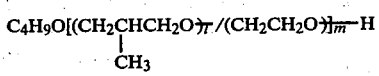

Butanol (148 g, 2.0 mols), KOH (17 g, 0.31 mol), PO (1,626 g, 28.03 mols) and EO (1,626 g, 36.95 mols) were subjected to random addition reaction, followed by the same manner as in the previous example, to obtain a colorless, transparent liquid poly(oxyethylene-oxypropylene) monobutyl ether (PO/EO ratio by weight=50/50, M.W. 1,700, random polymer) (3,264 g, yield 96%).

$$\text{iso-}C_8H_{17}O(CH_2\overset{CH_3}{\overset{|}{C}}HO)_n(CH_2CH_2O)_m-H$$

In the same manner as in the previous example, isooctyl alcohol (195 g, 1.50 mol), KOH (17.3 g, 0.31 mol), PO (2,115.0 g, 36.47 mols) and EO (1,139.0 g, 25.89 mols) gave a colorless, transparent liquid poly(oxyethylene,oxypropylene) monoisooctyl ether (PO/EO ratio by weight=65/35, M.W. 2,300, block polymer) (3,381 g, yield 98%).

$$C_{14}H_{29}O(CH_2\overset{CH_3}{\overset{|}{C}}HO)_n(CH_2CH_3O)_m-H$$

In the same manner as in the previous example, mylistyl alcohol (321 g, 1.50 mol), KOH (15 g, 0.27 mol), PO (1,607.4 g, 27.71 mols) and EO (1,071.6 g, 24.35 mols) gave a colorless, transparent liquid poly(oxyethylene,oxypropylene) monomylistyl ether (PO/EO ratio by weight=60/40, M.W. 2,000, block polymer) (2,880 g, yield 96%).

$$\begin{array}{l} CH_3-CHO(CH_2\overset{CH_3}{\overset{|}{C}}HO)_n(CH_2CH_2O)_m-H \\ \quad\quad\quad\

$M^2$: Na, K

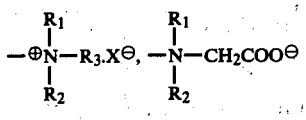

$R_1$–$R_3$: alkyl of 1–20 carbon atoms
X: Cl, Br, I, $R_4SO_4$
$R_4$: $CH_3$ or $C_2H_5$
n: integer of 4–14;

(II) 30 to 99.95% by weight of a poly(oxyethylene-oxypropylene) ether derivative having a molecular weight of 1,000 to 10,000, obtained by adding ethylene oxide and propylene oxide to a monohydric or polyhydric alcohol of 1 to 20 carbon atoms;
(III) 0 to 30% by weight of a nonionic surfactant; and
(IV) 0 to 40% by weight of a mineral oil having a viscosity at 30° C. of 5 to 30 cst or a fatty acid ester having a molecular weight of 300 to 700 or mixtures thereof.

2. An oiling agent for treating synthetic fibers according to claim 1 wherein said fluorine-containing ionic surfactant(s) are anionic surfactant(s) expressed by said general formula wherein said A comprises one of

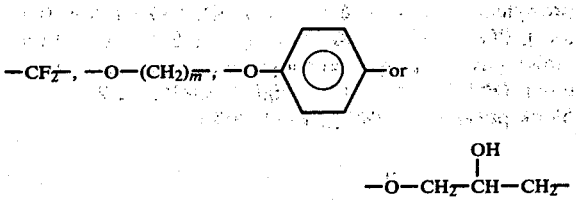

and said B comprises one of $-BO_3M^1$(l/k) or $-COOM^2$.

3. An oiling agent for treating synthetic fibers according to claim 1 wherein said fluorine-containing ionic surfactant(s) are cationic or amphoteric surfactant(s) expressed by said general formula wherein said A comprises one of

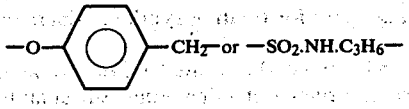

and said B comprises one of

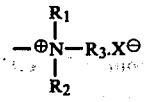

($R_1$–$R_3$: alkyl of 1–4 C,
X: Cl, Br, I, $CH_3SO_4$, $C_2H_5SO_4$) or

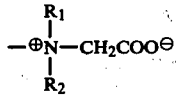

($R_1$–$R_2$: alkyl of 1–4 C).

4. An oiling agent for treating synthetic fibers according to claim 1 wherein said fluorine-containing ionic surfactant(s) are anionic surfactant(s) expressed by the following formula:

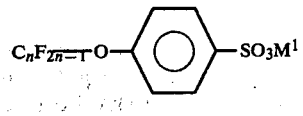

(l/k)
(n: integer of 6–9
$M^1$: Na, K, Ca, Mg).

5. An oiling agent for treating synthetic fibers according to claim 1 wherein said fluorine-containing ionic surfactant(s) are anionic surfactant(s) expressed by the following formula:

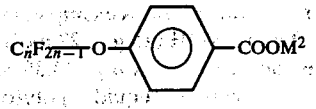

(n: integer of 6–9).

6. An oiling agent for treating synthetic fibers according to claim 1 wherein said fluorine-containing ionic surfactant(s) are anionic surfactant(s) expressed by the following formula:

$C_nF_{2n+1}-SO_3M^1$ (l/k)

(n: integer of 6–8
$M^1$: Na, K, Ca, Mg).

7. An oiling agent for treating synthetic fibers according to claim 1 wherein said fluorine-containing ionic surfactant(s) are amphoteric surfactant(s) expressed by the following formula:

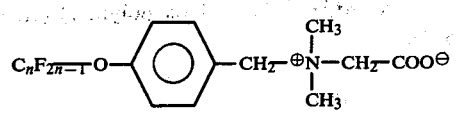

(n: integer of 6–9).

8. An oiling agent for treating synthetic fibers according to claim 1 wherein said fluorine-containing ionic surfactant(s) are cationic surfactant(s) expressed by the following formula:

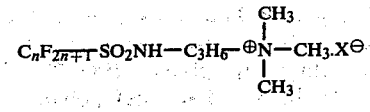

(n: integer of 6–8).

9. An oiling agent for treating synthetic fibers according to claim 1, wherein said fluorine-containing ionic surfactant(s) are anionic surfactant(s) expressed by the following formula:

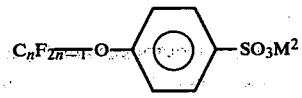

(n: integer of 6–9).

10. An oiling agent for treating synthetic fibers according to claim 1, wherein said fluorine-containing ionic surfactant(s) are anionic surfactant(s) expressed by the following formula:

$$C_nF_{2n+1}-SO_3M^2$$

(n: integer of 6–8).

11. An oiling agent for treating synthetic fibers according to claim 1 wherein said nonionic surfactant (III), said mineral oil (IV) and said fatty acid ester (IV) are not blended.

12. An oiling agent for treating synthetic fibers according to claim 1 wherein the ratio by weight (PO/EO) of propylene oxide (PO) to ethylene oxide (EO) in said poly(oxyethylene-oxypropylene) ether derivative is 80/20–20/80.

13. An oiling agent for treating synthetic fibers according to claim 1 wherein the alcohol as a raw material of said poly(oxyethylene-oxypropylene) ether derivative is mono- to tri-hydric alcohol.

14. An oiling agent for treating synthetic fibers according to claim 1 wherein the amount of said oiling agent fed to synthetic fibers is 0.1–2.0% by weight.

15. An oiling agent for treating synthetic fibers according to claim 1, which is used in the production step of polyester filaments.

16. An oiling agent for treating synthetic fibers according to claim 1, which is used in the production step of partially stretched yarns (preoriented yarns) of polyester filaments.

* * * * *